US009780479B2

(12) United States Patent
Guo

(10) Patent No.: US 9,780,479 B2
(45) Date of Patent: Oct. 3, 2017

(54) ELECTRICAL CONNECTOR HAVING AN IMPROVED METAL REINFORCING MEMBER

(71) Applicant: FOXCONN INTERCONNECT TECHNOLOGY LIMITED, Grand Cayman (KY)

(72) Inventor: Jing-Jie Guo, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/215,517

(22) Filed: Jul. 20, 2016

(65) Prior Publication Data

US 2017/0025782 A1 Jan. 26, 2017

(30) Foreign Application Priority Data

Jul. 20, 2015 (CN) ..... 2015 2 0524094 U

(51) Int. Cl.

| | |
|---|---|
| ***H01R 13/648*** | (2006.01) |
| ***H01R 13/504*** | (2006.01) |
| ***H01R 13/6581*** | (2011.01) |
| ***H01R 24/62*** | (2011.01) |
| *H01R 13/405* | (2006.01) |

(52) U.S. Cl.

CPC ..... *H01R 13/504* (2013.01); *H01R 13/6581* (2013.01); *H01R 24/62* (2013.01); *H01R 13/405* (2013.01)

(58) Field of Classification Search

CPC ..... H01R 13/648; H01R 13/6581; H01R 13/6587; H01R 13/6594; H01R 13/6873; H01R 23/7073; H01R 13/6598; H01R 23/02; H01R 24/60; H01R 24/62

USPC ..... 439/607.01, 607.4, 607.54, 660

See application file for complete search history.

(56) References Cited

U.S. PATENT DOCUMENTS

| | | | | |
|---|---|---|---|---|
| 7,682,199 | B2 | 3/2010 | Ahn et al. | |
| 8,956,187 | B2 * | 2/2015 | He | H01R 13/504 439/607.35 |
| 9,106,024 | B2 * | 8/2015 | Zhao | H01R 13/6594 |
| 9,225,130 | B2 * | 12/2015 | Zhang | H01R 13/405 |
| 9,231,356 | B1 * | 1/2016 | Ju | H01R 24/78 |
| 9,537,272 | B2 * | 1/2017 | Chien | H01R 24/62 |

(Continued)

FOREIGN PATENT DOCUMENTS

| | | |
|---|---|---|
| CN | 201656023 | 11/2010 |
| CN | 201904481 | 7/2011 |

(Continued)

*Primary Examiner* — Hae Moon Hyeon

(74) *Attorney, Agent, or Firm* — Wei Te Chung; Ming Chieh Chang

(57) ABSTRACT

An electrical connector includes an insulative housing, metal reinforcing member, a number of terminals affixed to the insulative housing, and a shielding shell enclosing the insulative housing. The insulative housing includes a base portion and a tongue portion extending forwardly from the base portion. The tongue portion defines a pair of lateral walls and a pair of positioning grooves located in front of the lateral walls. The metal reinforcing member includes a pair of engaging portions located in front of the lateral walls and engaged with the positioning grooves of the tongue portion. The engaging portions are aligned with the lateral walls.

14 Claims, 10 Drawing Sheets

(56) References Cited

U.S. PATENT DOCUMENTS

| | | | | |
|---|---|---|---|---|
| 2014/0073184 | A1* | 3/2014 | Zhao | H01R 13/6594 439/607.55 |
| 2014/0099835 | A1* | 4/2014 | Chang | H01R 13/6581 439/682 |
| 2014/0315446 | A1* | 10/2014 | He | H01R 13/504 439/701 |
| 2014/0357124 | A1 | 12/2014 | Zhao et al. | |
| 2015/0111436 | A1* | 4/2015 | Zhang | H01R 13/405 439/676 |
| 2015/0207257 | A1* | 7/2015 | Dai | H01R 13/405 439/660 |
| 2015/0207281 | A1* | 7/2015 | Chien | H01R 24/62 439/676 |
| 2015/0270661 | A1* | 9/2015 | Kao | H01R 13/5202 439/271 |

FOREIGN PATENT DOCUMENTS

| | | |
|---|---|---|
| CN | 201956523 | 8/2011 |
| CN | 202395222 | 8/2012 |
| CN | 203014026 | 6/2013 |

* cited by examiner

ELECTRICAL CONNECTOR HAVING AN IMPROVED METAL REINFORCING MEMBER

BACKGROUND OF THE DISCLOSURE

1. Field of the Disclosure

The invention relates to an electrical connector, especially an electrical connector having an improved metal reinforcing member.

2. Description of Related Arts

China Patent No. 201904481 discloses an electrical connector including an insulative housing, a plurality of terminals affixed to the insulative housing, a metal reinforcing member, and a shielding shell enclosing the insulative housing for forming a receiving room. The insulative housing includes a base portion and a tongue portion extending from the base portion. The metal reinforcing member has a main portion, a pair of lateral walls extending from the main portion, and a pair of fixing legs extending backwardly from the main portion. The terminals are affixed to the tongue portion and are so close to the lateral walls as to cause a concern that the outermost terminals and the metal reinforcing member may become short circuited.

An improved electrical connector is desired.

SUMMARY OF THE DISCLOSURE

Accordingly, an object of the present disclosure is to provide an electrical connector with improved metal reinforcing member and tongue portion for preventing short circuiting.

To achieve the above object, an electrical connector comprises: an insulative housing having a base portion and a tongue portion extending forwardly from the base portion, the tongue portion defining an upper surface, an opposite lower surface, a pair of lateral walls, and a pair of positioning grooves in front of the lateral walls; a metal reinforcing member affixed to the insulative housing, the reinforcing member comprising a pair of engaging portions located in front of the lateral walls and engaged with the positioning grooves of the tongue portion, the engaging portions being aligned with the lateral walls; a plurality of terminals affixed to the insulative housing; and a shielding shell enclosing the insulative housing to form a receiving room therein.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
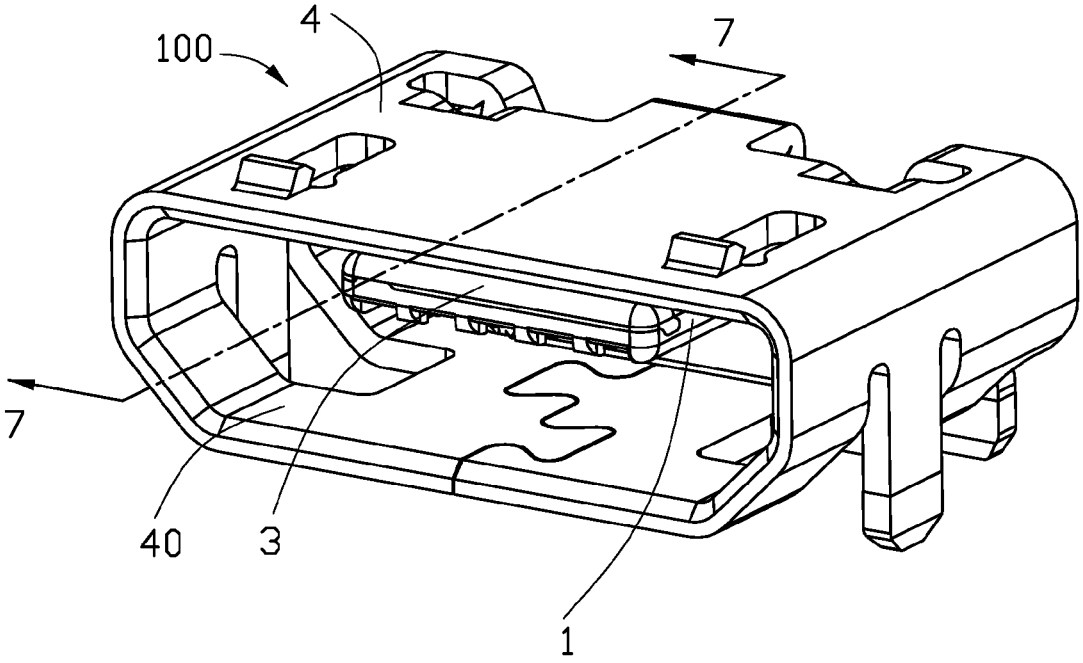
FIG. 1 is a perspective, assembled view of an electrical connector of the present disclosure.
Figure 2:
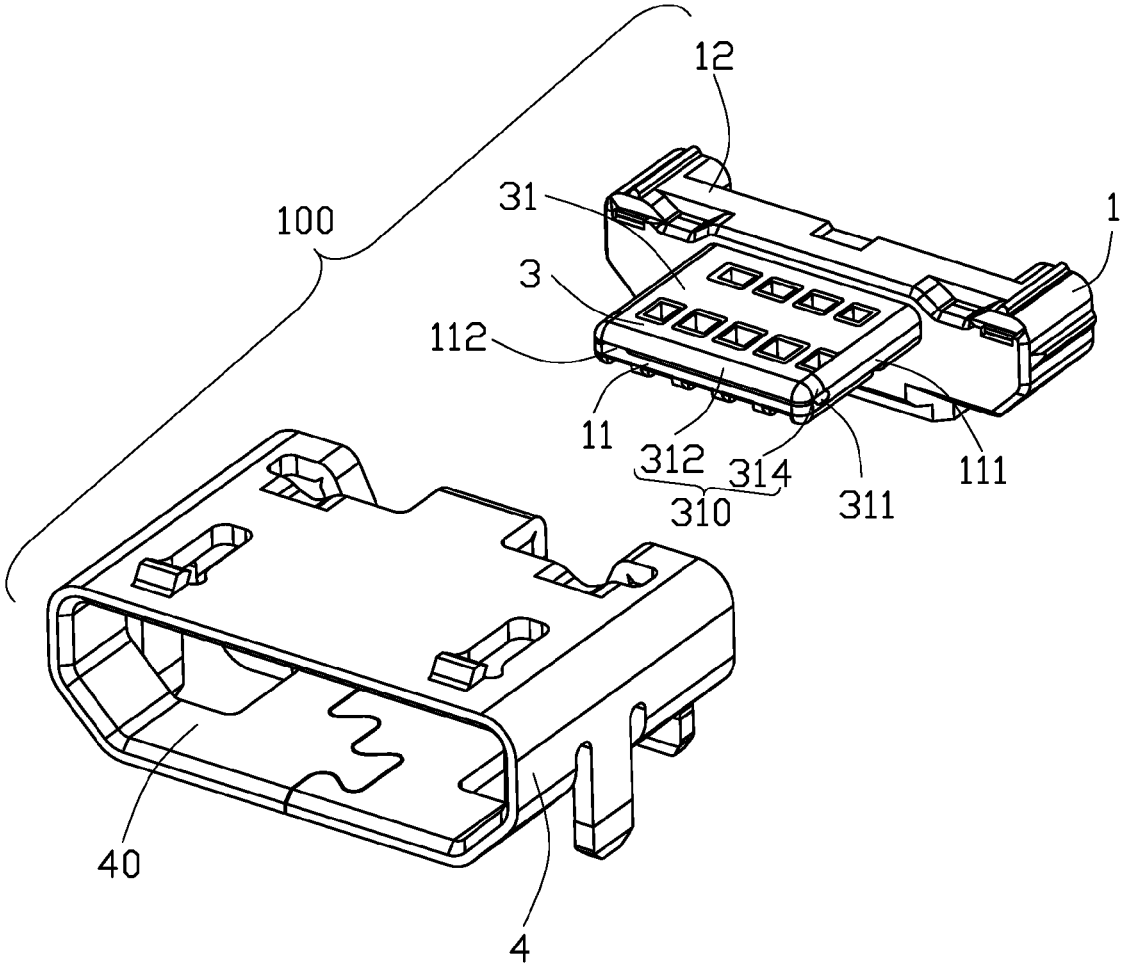
FIG. 2 is a partly exploded view of the electrical connector of FIG. 1.
Figure 3:
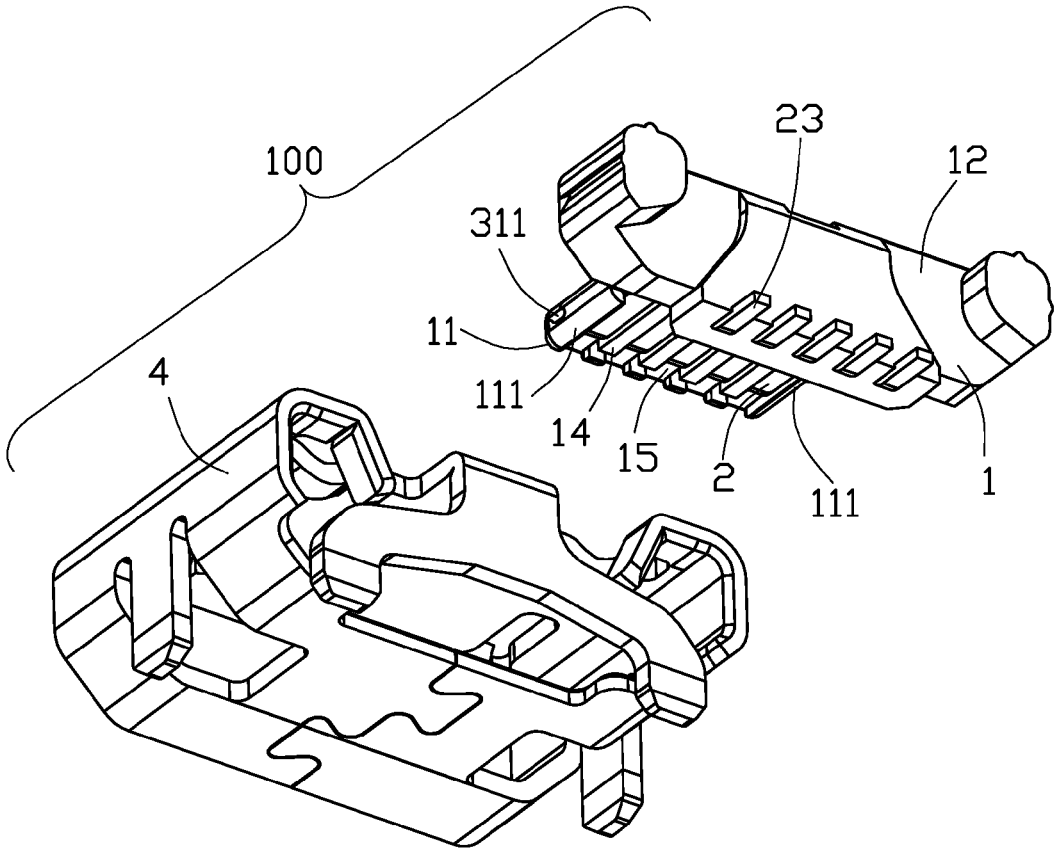
FIG. 3 is a view similar to FIG. 2 but from a different perspective.

Reference will now be made in detail to the preferred embodiment of the present disclosure. Referring to FIGS. 1 to 7, an electrical connector includes an insulative housing 1, a number of terminals 2 disposed in the insulative housing 1 in one row along a transverse direction, a metal reinforcing member 3 affixed to the insulative housing 1 and a shielding shell 4 enclosing the insulative housing and forming a receiving room 40.

The insulative housing 1 includes a base portion 12, a tongue portion 11 extending forwardly from the base portion 12 along a front-to-back direction perpendicular to the transverse direction and a plurality of terminals grooves 15 receiving the terminals 2. The tongue portion 11 defines an upper surface 13, a lower surface 14 corresponding with the upper surface 13 and a pair of lateral walls 111 extending vertically for connecting the upper surface 13 and the lower surface 14. The lateral walls 111 are exposed to the receiving room 40. On both sides of the front end of the tongue portion 11 are provided with a pair of positioning grooves 112. The tongue portion 11 is provided with an engaging block 113 extending upwardly from the tongue portion 11.

Figure 4:
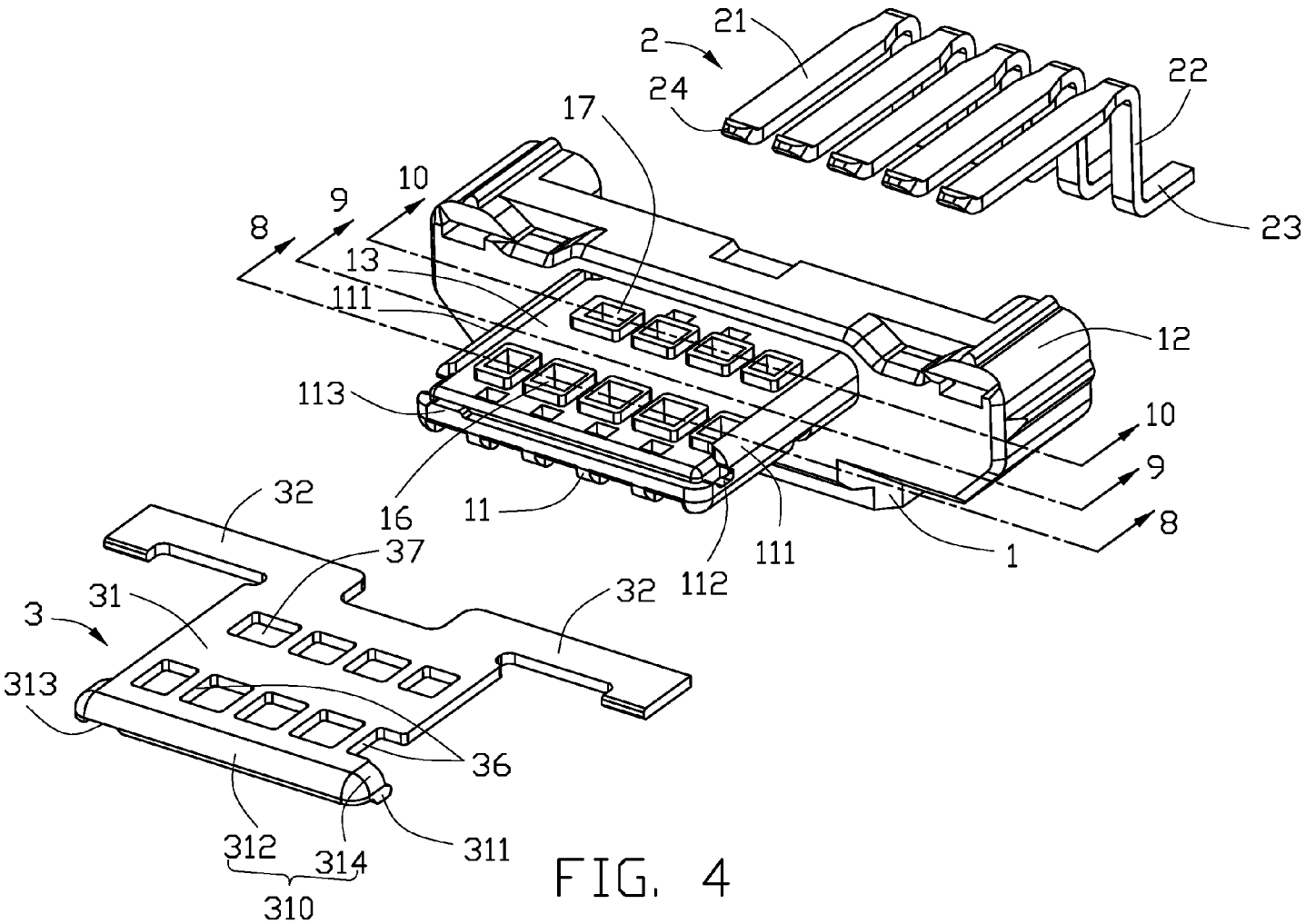
FIG. 4 is a further exploded view of the electrical connector of FIG. 1 omitting a shielding shell thereof.
Figure 5:
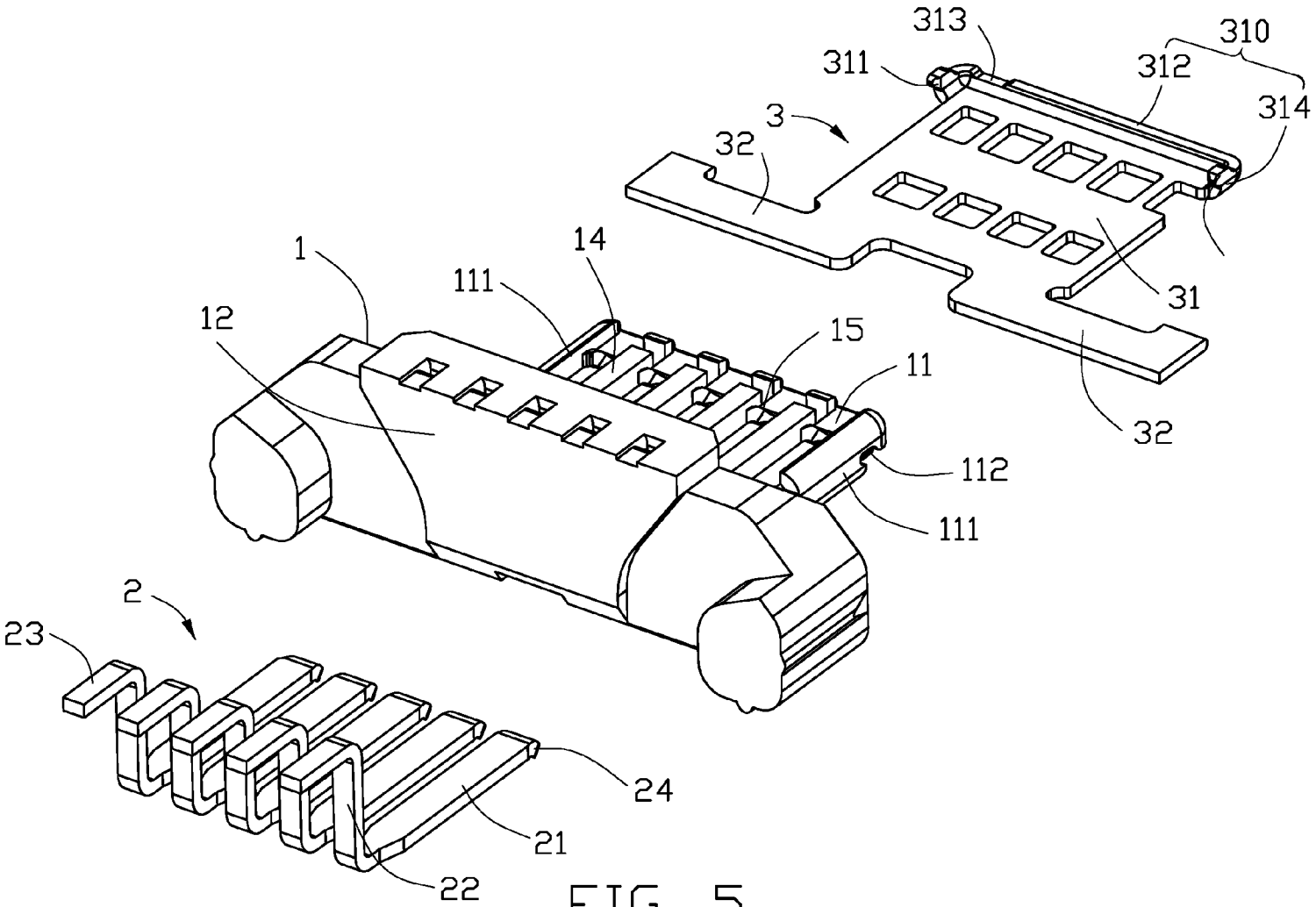
FIG. 5 is a view similar to FIG. 2 but from a different perspective.

The metal reinforcing member 3 is composed of a metal stamping blank of integrally. The metal reinforcing member 3 is mounted on the upper surface 13 and coincides with the shape of the tongue portion 11. The metal reinforcing member 3 and an upper surface of the lateral walls 111 are in the same plane. The metal reinforcing member 3 includes a main portion 31 attached to the upper surface 13 of the tongue portion 11 and a pair of holding portions 32 extending outwardly from a back of the main portion 31. The main portion 31 is exposed to the receiving room 40. The holding portions 32 are affixed to or embedded in the base portion 12. The lateral walls 111 enclose the both sides of the main portion 31. Referring to FIGS. 4 to 5, the main portion 31 includes a front portion 310 having a front wall 312, a pair of bending portions 314 beside the front wall 312 and an engaging groove 313 mated with the engaging block 113. The front wall 312 partially overlaps the forehead of tongue portion 11. A pair of engaging portions 311 of the reinforcing member 3 are hooked at front end regions of the lateral walls of the tongue portion 11.

Referring to FIGS. 2 to 7, each terminal 2 received in the terminal groove 15 including a contact portion 21 connected electrically with the corresponding connector, a bending portion 22 affixed to the insulative housing 1, a soldering portion 23 exposed on a back of the base portion 12 and soldered with the printed circuit board and an extension portion 24 bending upwardly from the forehead of the contact portion 21. The extension portion 24 is inserted into the rear end of the terminal groove 15 preventing warping when the contact portion 21 is used.

When the electrical connector 100 is installed, the terminals 2 are affixed to the insulative housing 1. The contact portion 21 is exposed to the lower surface 14. The extension portion 24 engages with the terminal groove 15 at the rear end therein to avoid the contact portion 21 warping when the electrical connector 100 is mated with the corresponding connector. The front wall 312 of the metal reinforcing member 3 could protect the tongue portion 11 from scratching. The engaging portion 311 mates with the positioning grooves 112 which could prevent the tilt of the metal reinforcing member 3. The engaging block 113 engages with the engaging groove 313 to prevent the displacement in the lateral direction of the metal reinforcing member 3. The metal reinforcing member 3 enhances the intensity of the base portion 12 and the tongue portion 11. The metal reinforcing member 3 are affixed to the insulative housing 1 by the engaging portion 311 and the holding portions 32. The tongue portion 11 includes a pair of lateral walls 111 enclosing two sides of the metal reinforcing member 3 making it hard for the metal reinforcing member 3 and the terminals 2 to contact.

From a technical viewpoint, the tongue portion 11 forms a plurality of first through holes 16 each to receive a corresponding molding core pin for holding the contact portion 21 of the corresponding terminal 2 in both the vertical direction and the (leftward) lateral direction during the insert-molding process, and a plurality of second through holes 17 each to receive another corresponding molding core pin for holding the contact portion 21 of the corresponding terminal 2 in the vertical direction and the (rightward) lateral direction during the insert-molding process. Similarly, the reinforcing member 3 also forms the corresponding first apertures 36 and second apertures 37 in alignment with the corresponding first and second through holes 16 and 17, respectively. In this embodiment, the through holes 16 are not symmetrically arranged in the tongue portion 11 with regard to the centerline thereof, and the through holes 17 are not as well. Similarly, the apertures 36 are not symmetrically arranged with regard to the centerline of the reinforcing member 3 and the aperture are not as well. Anyhow, the positioning grooves 112 are symmetrical with regard to the centerline of the tongue portion 11, and the engaging portions 311 are symmetrical with regard to the centerline of the reinforcing member 3.

Figure 6:
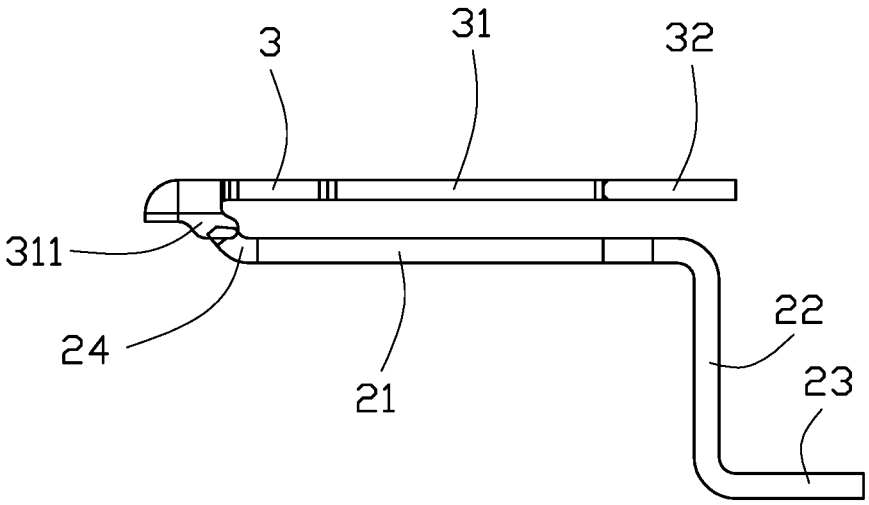
FIG. 6 is a schematic side view showing positional relationship between a metal reinforcing member and a terminal thereof.
Figure 7:
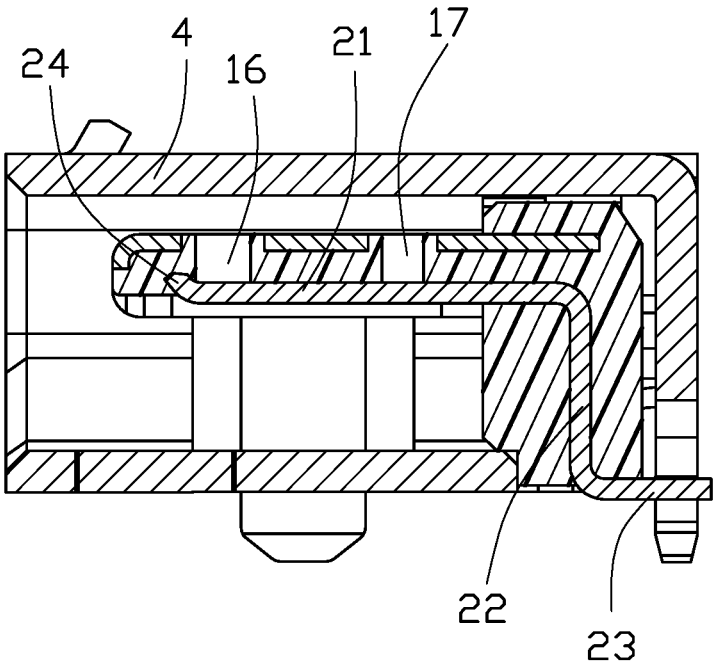
FIG. 7 is a cross-sectional view of the electrical connector of FIG. 1.
Figure 8:
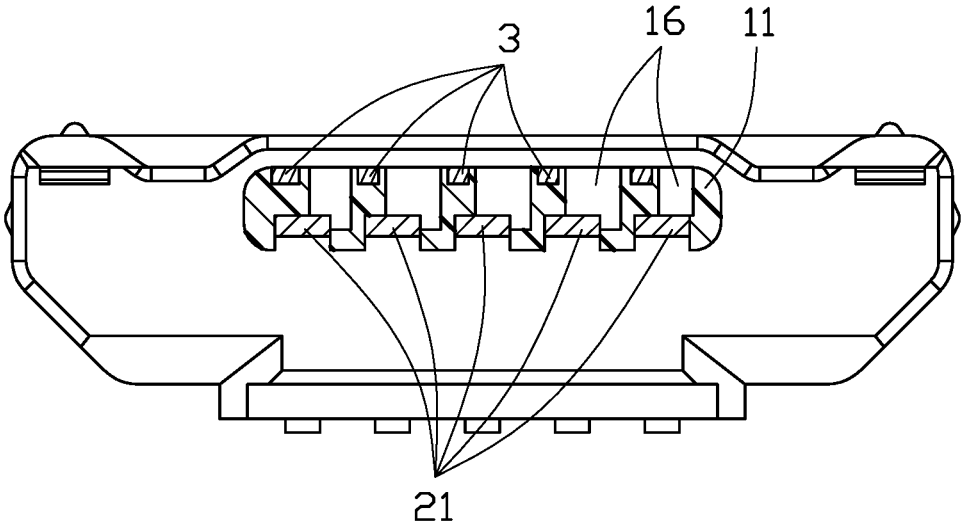
FIG. 8 is a cross-sectional view of the electrical connector of FIG. 1 along line 8-8 without the shell.
Figure 9:
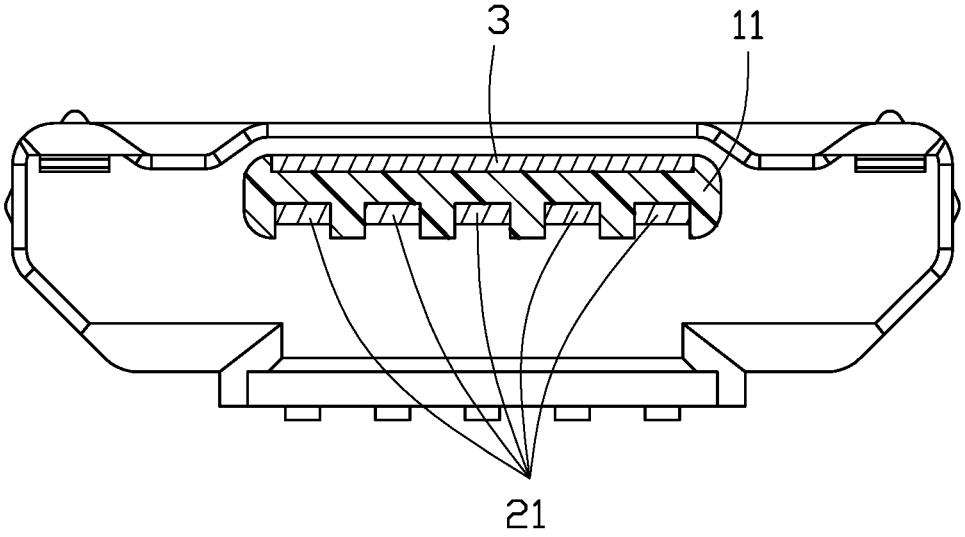
FIG. 9 is a cross-sectional view of the electrical connector of FIG. 1 along line 9-9 without shell.
Figure 10:
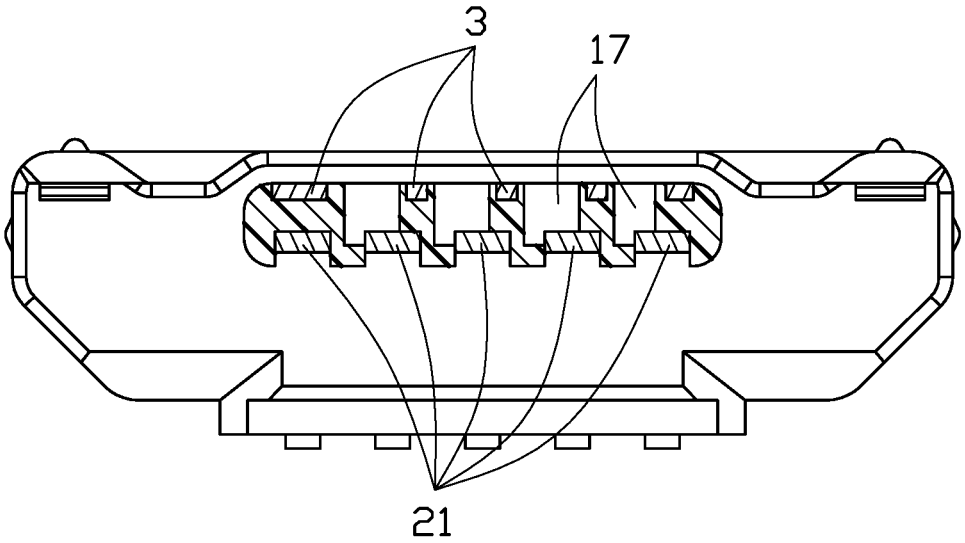
FIG. 10 is a cross-sectional view of the electrical connector of FIG. 1 along line 10-10 without shell.

In brief, in the instant invention, on one hand the lateral side edges of the tongue portion 11 are essentially exposed to an exterior without shield by the reinforcing member 3 for lowering the shorting between the contact portion 21 of the leftmost terminal 2 and the reinforcing member 3 in the lateral direction; on the other hand, only the engaging portion 311 grasps the front region of the lateral side edge of the tongue portion 11, which is only slightly overlapped with the front end of the outermost terminal 2 in the lateral direction as shown in FIG. 6 so as to have the least shorting risk therebetween. Based upon this arrangement, the whole connector may have less risk of shorting while still keeping the required retention between the reinforcing member 3 and the tongue portion 11 by the engaging portions 311 advantageously.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing having a base portion and a tongue portion extending forwardly from the base portion, the tongue portion defining an upper surface, an opposite lower surface, a pair of lateral walls extending upwardly and downwardly from both sides of the upper surface and the lower surface, and a pair of positioning grooves in front of the lateral walls;

a shielding shell enclosing the insulative housing to form a receiving room therein;

a metal reinforcing member affixed to the insulative housing and mounted to the upper surface, the reinforcing member comprising a pair of engaging portions located in front of the lateral walls and engaged with the positioning grooves of the tongue portion, a main portion exposed to the receiving room, and a pair of holding portions extending backwardly from the main portion and embedded in the base portion, the lateral walls enclosing two sides of the main portion, the engaging portions being aligned with the lateral walls; and a plurality of terminals affixed to the insulative housing.

2. The electrical connector as claimed in claim 1, wherein the metal reinforcing member has a front portion located at a forehead of the main portion, and the front portion has a front wall partially enclosing a front end of the tongue portion.

3. The electrical connector as claimed in claim 2, wherein the front wall has an engaging groove, and the tongue portion has at a front end of the upper surface an engaging block mated with the engaging groove.

4. The electrical connector as claimed in claim 2, wherein the front portion comprises a pair of lateral bending portions, and the engaging portions extend downwardly from the bending portions.

5. The electrical connector as claimed in claim 1, wherein each terminal comprises a contact portion exposed to the lower surface, a bending portion, and a soldering portion exposed to a backend of the base portion, and the contact portion comprises a front extension portion bent upwardly.

6. The electrical connector as claimed in claim 1, wherein the insulative housing is insert-molded with the terminals and the metal reinforcing member.

7. The electrical connector as claimed in claim 1, wherein the metal reinforcing member is a one-piece stamped metal.

8. An electrical connector comprising:

an insulative housing including a base portion and a tongue portion forwardly extending therefrom in a front-to-back direction and defining opposite first surface on a bottom thereof and second surface on a top thereof in a vertical direction perpendicular to said front-to-back direction;

a plurality of terminals disposed in the housing in one row along a transverse direction perpendicular to both said front-to-back direction and said vertical direction, each of said terminals including a contact portion exposed upon the first surface; and a metallic reinforcing member located upon the second surface via an insert-molding process with the housing; wherein the reinforcing member includes a pair of engaging portions hooked with a pair of positioning grooves at front end regions of a pair of lateral side edges of the tongue portion, respectively, while still keeping remaining portions of the pair of lateral side edges of the tongue portion laterally and outwardly exposed to an exterior.

9. The electrical connector as claimed in claim 8, further including a plurality of first holes formed in the tongue portion within the first surface thereof and communicating with the corresponding contact portions in both the vertical direction and a leftward transverse direction, and a plurality of second holes formed in the tongue portion within the second surface thereof, spaced from the first holes in the front-to-back direction, and communicating with the corresponding contact portions in both the vertical direction and a rightward transverse direction.

10. The electrical connector as claimed in claim 9, wherein said first holes are asymmetrical with regard to a front-to-back centerline of the tongue portion, and said second holes are asymmetrical with regard to the front-to-back centerline of the tongue portion.

11. The electrical connector assembly as claimed in claim 9, wherein said reinforcing member further defines a plurality of first apertures aligned with the corresponding first holes in the vertical direction, and a plurality of second apertures aligned with the corresponding second holes in the vertical direction.

12. The electrical connector as claimed in claim 11, wherein said first apertures are asymmetrical with regard to a front-to-back centerline of the reinforcing member, and said second apertures are asymmetrical with regard to the front-to-back centerline of the reinforcing member.

13. The electrical connector as claimed in claim 8, wherein said tongue portion forms a pair of positioning grooves in said pair of lateral side edges to receive the corresponding engaging portions, respectively.

14. The electrical connector as claimed in claim 8, wherein the contact portion of an outermost terminal and the reinforcing member are overlapped with each other in the transverse direction only at a front end region of the contact portion for lowering shorting risks therebetween in said transverse direction.

* * * * *